US007762845B1

(12) United States Patent
Huang et al.

(10) Patent No.: US 7,762,845 B1
(45) Date of Patent: Jul. 27, 2010

(54) STRUCTURE OF A THIN CONNECTOR

(75) Inventors: Kuo-chih Huang, Taoyuan (TW); Wen-Tsan Huang, Taoyuan (TW)

(73) Assignee: GEM-SUN Technologies Co., Ltd., Taoyuan (TW)

( * ) Notice: Subject to any disclaimer, the term of this patent is extended or adjusted under 35 U.S.C. 154(b) by 0 days.

(21) Appl. No.: 12/463,616

(22) Filed: May 11, 2009

(51) Int. Cl.
*H01R 13/648* (2006.01)

(52) U.S. Cl. ..... 439/607.22; 439/76.1; 439/607.56

(58) Field of Classification Search ..... 439/607.22, 439/607.56, 607.53, 76.1
See application file for complete search history.

(56) References Cited

U.S. PATENT DOCUMENTS 6,081,431 A * 6/2000 Lemke ..... 439/76.1
6,247,968 B1 * 6/2001 Wu ..... 439/607.22
6,290,542 B1 * 9/2001 Kuo ..... 439/607.49
7,052,287 B1 * 5/2006 Ni et al. ..... 439/76.1
7,104,809 B1 * 9/2006 Huang ..... 439/76.1
7,108,518 B2 * 9/2006 Tseng ..... 439/76.1
7,192,297 B1 * 3/2007 Wu ..... 439/607.01
7,252,548 B2 * 8/2007 Huang ..... 439/607.01

FOREIGN PATENT DOCUMENTS

TW 259990 3/2005

* cited by examiner

*Primary Examiner*—Briggitte R Hammond
(74) *Attorney, Agent, or Firm*—Wang Law Firm; Li K. Wang

(57) ABSTRACT

A thin connector structure includes an upper iron shell, a lower iron shell, a circuit board, a protective layer and a glue layer. The circuit board is interposed between the upper and lower iron shells. Both sides on the inner surface of the lower iron shell are provided with a pin, respectively. Both sides of the circuit board have a fixing hole, respectively. The pins go through the corresponding fixing holes. The protective layer is interposed between the upper iron shell and the circuit board to prevent dissipation of electromagnetic waves. The glue layer is interposed between the lower iron shell and the circuit board for positioning the connector structure.

4 Claims, 3 Drawing Sheets

STRUCTURE OF A THIN CONNECTOR

FIELD OF INVENTION

The invention relates to a thin connector structure and, in particular, to a connector structure that prevents electromagnetic waves from dissipation.

RELATED ART

Taiwan, R.O.C. Pat. No. M259990 discloses a soft bus line structure that can prevent electromagnetic (EM) waves. The bottom surface of the soft bus line is adhered with a glue layer. Its top surface is adhered with a metal shielding layer by mesh printing. The metal lines on the metal shielding layer form a geometric pattern so that the structure can shield electromagnetic interference (EMI).

Apparently, the prior art needs improvements.

SUMMARY OF THE INVENTION

In view of the foregoing, an objective of the invention is to provide a thin connector structure that reduces EM wave dissipation by having a protective layer at the connector. This does not only prevent EMI on the electronic device, but also protect human body health.

To achieve the above-mentioned objective, the invention includes: an upper iron shell, a lower iron shell connected to the upper iron shell, a circuit board with signal lines, a protective layer for preventing EM waves dissipation, and a glue layer.

Both sides of the upper iron shell have a first wall, respectively. The end edges of the two first walls are bent toward each other to form a second wall, respectively. A first back opening is formed between the two second walls. The upper iron shell extends outwards a first bottom board from the first back opening. The other side of the upper iron shell has a first front opening opposite to the first back opening. The two first walls and the two second walls surround inside the upper iron shell to form an upper accommodating space.

Both sides of the lower iron shell have a third wall, respectively. The end edges of the two third walls are bent toward each other to form a fourth wall, respectively. A second back opening is formed between the two fourth walls. The lower iron shell extends outwards a second bottom board from the second back opening, opposite to the first bottom board. The first back opening and the second back opening together form a back insertion opening between the first and second bottom boards. The other side of the lower iron shell has a second front opening opposite to the first back opening. The first and second front openings form a front insertion opening. The two third walls and the two fourth walls surround inside the upper iron shell to form a lower accommodating space opposite to the upper accommodating space. The upper and lower accommodating spaces form a total accommodating region. A pin is provided at the bending portion of the lower shell between the two third walls and the two fourth walls.

The circuit board is disposed in the total accommodating region between the upper and lower shells. The front side of the circuit board has several male terminals at the front insertion opening. The male terminals extend toward the back side of the circuit board and shrink. There are several wire parts in the total accommodating region. The wire parts further extend to the back side of the circuit board and have several signal connecting parts at the back insertion opening. Both sides of the circuit board near the wire parts protrude outward to form an extending part, respectively. Each of the extending parts has a fixing hole corresponding to the pins. The pin goes into the fixing hole.

The protective layer is interposed between the upper iron shell and the circuit board. Both sides of the protective layer extend to the extending parts. The front side of the protective layer extends to the male terminals. The back side of the protective layer extends to the signal connecting parts. The protective layer further forms a first bending section whose shape matches with the circuit board from the total accommodating region to the two sides of the back insertion opening.

The glue layer is interposed between the circuit board and the lower iron shell. Both sides of the glue layer extend to the circuit board extending parts. The front side of the glue layer extends toward the male terminals. The back side of the glue layer extends toward the signal connecting parts. The glue layer further forms a second bending section opposite to the first bending section of the circuit board. The glue layer also urges against the circuit board and the lower iron shell.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
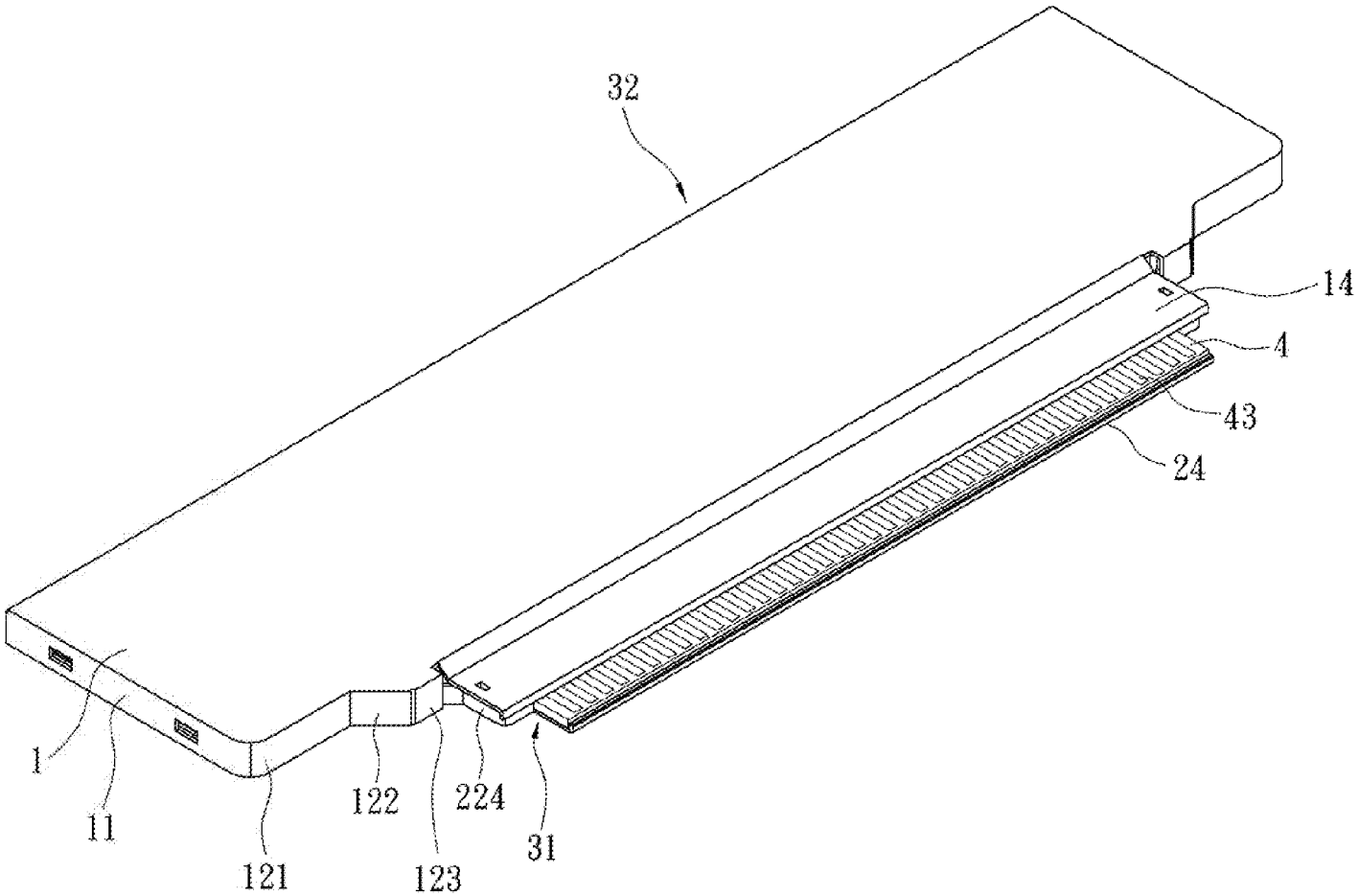
FIG. 1 is a three-dimensional assembly view of the disclosed thin connector structure.
Figure 2:
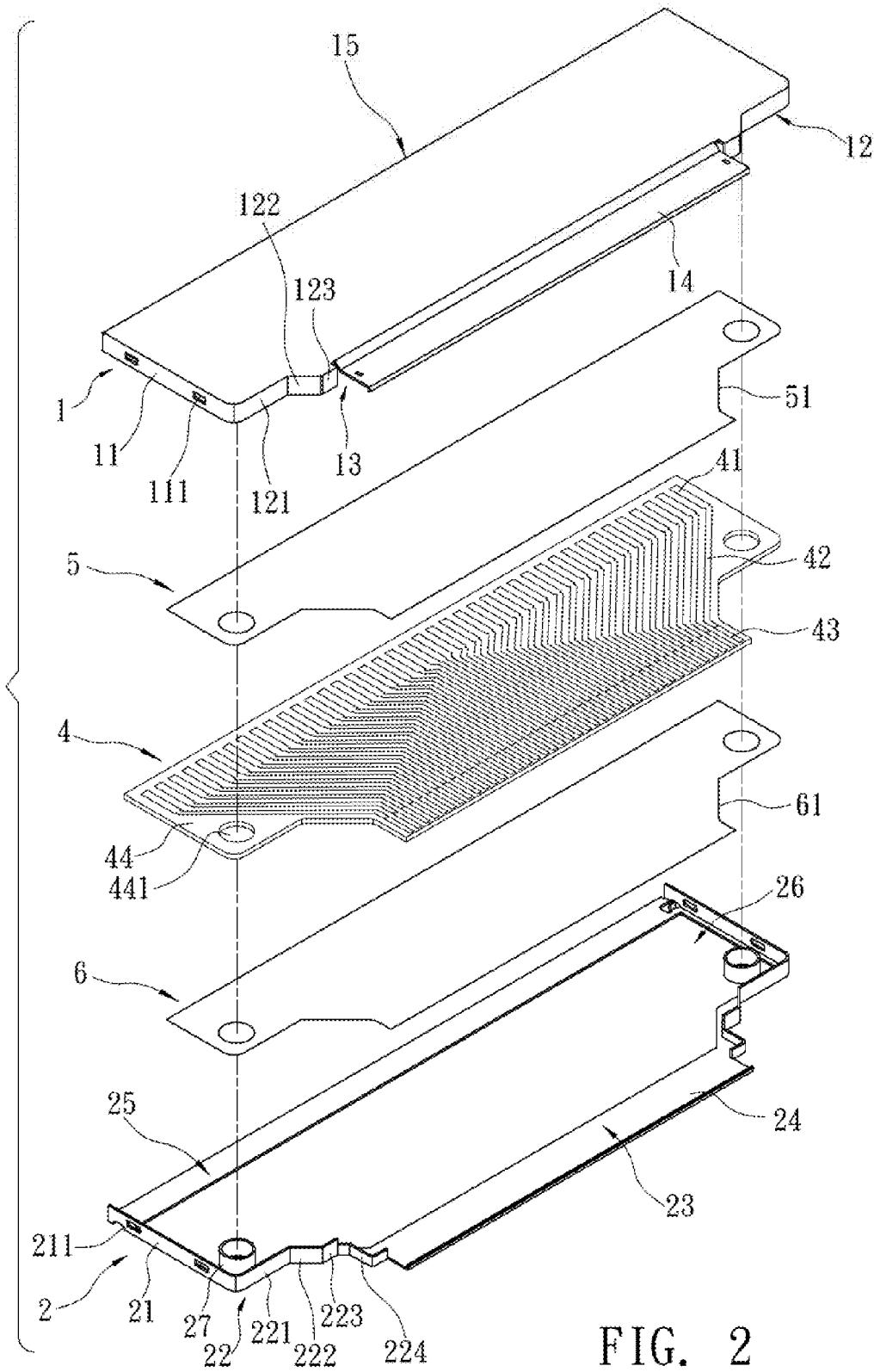
FIG. 2 is a three-dimensional exploded view of the disclosed thin connector structure.
Figure 3:
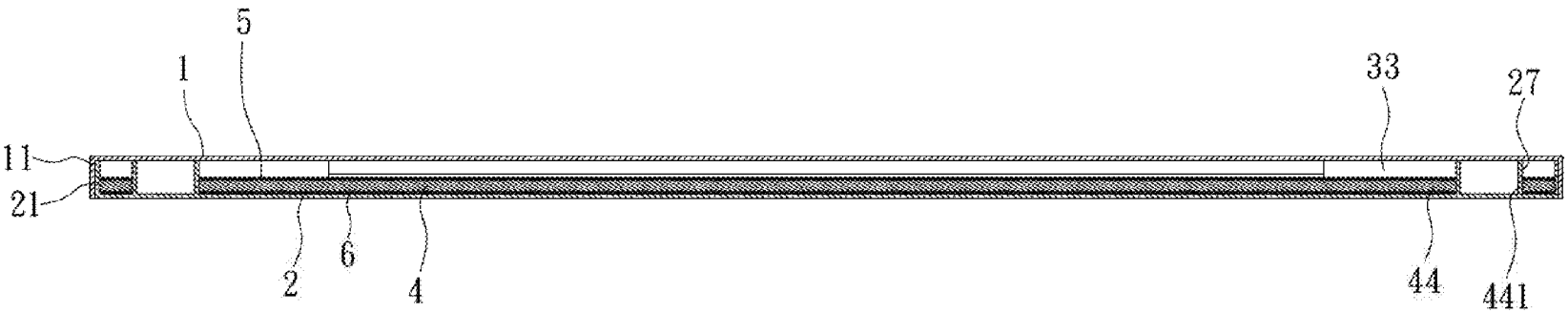
FIG. 3 is a schematic cross-sectional view of the disclosed thin connector structure.

FIGS. 1 to 3 show an embodiment of the invention. This embodiment is used solely for the purpose of explanation. The scope of the invention is not limited by this particular structure. Moreover, the orientation mentioned in the description refers to the drawings.

The disclosed thin connector structure includes: an upper iron shell 1, a lower iron shell 2 connected to the upper iron shell 1, a circuit board 4 with signal lines, a protection layer 5 for preventing EM waves dissipation, and a glue layer 6.

Both sides of the upper iron shell 1 have a first wall 11, respectively. The end edges of the two first walls 11 are bent toward each other to form a second wall 12, respectively. A first back opening 13 is formed between the two second walls 12. The upper iron shell 1 extends outwards a first bottom board 14 from the first back opening 13. The other side of the upper iron shell 1 has a first front opening 15 opposite to the first back opening 13. The two first walls 11 and the two second walls 12 surround inside the upper iron shell to form an upper accommodating space.

In this embodiment, the two second walls 12 of the upper iron shell 1 have a first section 121. The first section 121 forms a slant section 122 toward the first bottom board 14. The slant section 122 further extends out a second section 123 to the first bottom board 14.

Both sides of the lower iron shell 2 have a third wall 21, respectively. The end edges of the two third walls 21 are bent toward each other to form a fourth wall 22, respectively. A second back opening 23 is formed between the two fourth walls 22. The lower iron shell 2 extends outwards a second bottom board 24 from the second back opening 23, opposite to the first bottom board 14. The first back opening 13 and the second back opening 23 together form a back insertion opening 31 between the first and second bottom boards 14, 24. The other side of the lower iron shell 2 has a second front opening 25 opposite to the first back opening 23. The first and second front openings 15, 25 form a front insertion opening 32. The two third walls 21 and the two fourth walls 22 surround inside the upper iron shell 1 to form a lower accommodating space 26 opposite to the upper accommodating space. The upper and lower accommodating spaces form a total accommodating region 33. A pin 27 is provided at the bending portion of the lower shell 2 between the two third walls 21 and the two fourth walls 22.

In this embodiment, the two fourth walls 22 of the lower iron shell 2 include a third section 221. The third section 221 has a slant section 222 toward the second bottom board 24. The slant section 222 further extends out a fourth section 223. The fourth section 223 also extends out a fifth section 224 to the second bottom board 24.

Of course, the components o the second walls 12 of the upper iron shell 1 match those on the fourth walls 22 of the lower iron shell 2.

Moreover, the two first walls 11 of the upper iron shell 1 have at least one buckling structure 111, respectively. The two third walls 21 of the lower iron shell 2 have at least one second buckling structure 211, respectively. The first and second buckling structures 111, 211 buckle with each other to combine the upper and lower iron shells 1, 2.

The circuit board 4 is disposed in the total accommodating region 33 between the upper and lower shells 1, 2. The front side of the circuit board 4 has several male terminals 41 at the front insertion opening 32. The male terminals 41 extend toward the back side of the circuit board 4 and shrink. There are several wire parts 42 in the total accommodating region 33. The wire parts 42 further extend to the back side of the circuit board 4 and have several signal connecting parts 43 at the back insertion opening 31. Both sides of the circuit board 4 near the wire parts 42 protrude outward to form an extending part 44, respectively. Each of the extending parts 44 has a fixing hole 441 (e.g., circular hole) corresponding to the pins 27. The pin 27 goes into the corresponding fixing hole 441.

The protective layer 5 is interposed between the upper iron shell 1 and the circuit board 4. Both sides of the protective layer 5 extend to the extending parts 44. The front side of the protective layer 5 extends to the male terminals 41. The back side of the protective layer 5 extends to the signal connecting parts 43. The protective layer 5 further forms a first bending section 51 whose shape matches with the circuit board 4 from the total accommodating region 33 to the two sides of the back insertion opening 31.

The glue layer 6 is interposed between the circuit board 4 and the lower iron shell 2. Both sides of the glue layer 6 extend to the circuit board extending parts 44. The front side of the glue layer 6 extends toward the male terminals 41. The back side of the glue layer 6 extends toward the signal connecting parts 43. The glue layer 6 further forms a second bending section 61 opposite to the first bending section 51 of the circuit board 4. The glue layer 6 also urges against the circuit board 4 and the lower iron shell 2.

Of course, the above-mentioned protective layer 5 and glue layer 6 do not have fixed position between the upper and lower iron shells 1, 2 and the circuit board 4. They can be interchanged. Moreover, the upper and lower shells in the invention can be made of some other appropriate metal.

With reference to FIG. 3, after assembly, the upper and lower iron shells 1, 2 enclose the protective layer 5, the circuit board 4 and the glue layer 6 therein. The fixing holes 441 on both sides of the circuit board 4 are penetrated through by the pins 27 of the lower iron shell 2. The protective layer 5 is laid out according to the profile of the circuit board 4 to achieve the optimal protection against EM waves. In particular, the glue layer 6 is laid out according to the profile between the circuit board 4 and the lower iron shell 2, so that its upper and lower surfaces tightly urge against the circuit board 4 and the lower iron shell 2, respectively. Therefore, the connector structure becomes tight and sturdy.

In summary, the disclosed thin connector has a protective layer on its circuit board to prevent EM waves from radiating out. This avoids dissipation of EM waves that may interfere with the operations of electronic devices as well as affect human health.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A thin connector structure, comprising:

an upper iron shell, both sides of which have a first wall, respectively; wherein the end edges of the two first walls are bent toward each other to form a second wall, respectively; a first back opening is formed between the two second walls; the upper iron shell extends outwards a first bottom board from the first back opening; the other side of the upper iron shell has a first front opening opposite to the first back opening; and the two first walls and the two second walls surround inside the upper iron shell to form an upper accommodating space;

a lower iron shell connect to the upper iron shell, both sides of which have a third wall, respectively; wherein the end edges of the two third walls are bent toward each other to form a fourth wall, respectively; a second back opening is formed between the two fourth walls; the lower iron shell extends outwards a second bottom board from the second back opening, opposite to the first bottom board; the first back opening and the second back opening together form a back insertion opening between the first and second bottom boards; the other side of the lower iron shell has a second front opening opposite to the first back opening; the first and second front openings form a front insertion opening; the two third walls and the two fourth walls surround inside the upper iron shell to form a lower accommodating space opposite to the upper accommodating space; the upper and lower accommodating spaces form a total accommodating region; and a pin is provided at the bending portion of the lower shell between the two third walls and the two fourth walls;

a circuit board with signal lines, which is disposed in the total accommodating region between the upper and lower shells; wherein the front side of the circuit board has several male terminals at the front insertion opening; the male terminals extend toward the back side of the circuit board and shrink; there are several wire parts in the total accommodating region; the wire parts further extend to the back side of the circuit board and have several signal connecting parts at the back insertion opening; both sides of the circuit board near the wire parts protrude outward to form an extending part, respectively; each of the extending parts has a fixing hole corresponding to the pins; and the pins go into the corresponding fixing holes;

a protective layer for preventing EM waves dissipation, which is interposed between the upper iron shell and the circuit board; wherein both sides of the protective layer extend to the extending parts; the front side of the protective layer extends to the male terminals; the back side of the protective layer extends to the signal connecting parts; and the protective layer further forms a first bending section whose shape matches with the circuit board from the total accommodating region to the two sides of the back insertion opening; and a glue layer, which is interposed between the circuit board and the lower iron shell; wherein both sides of the glue layer extend to the circuit board extending parts; the front side of the glue layer extends toward the male terminals the back side of the glue layer extends toward the signal connecting parts; the glue layer further forms a second bending section opposite to the first bending section of the board; and the glue layer also urges against the board and the lower iron shell.

2. The thin connector structure of claim 1, wherein the two second walls of the upper iron shell include a first section that forms a slant section toward the first bottom board, the slant section further extending out a second section to the first bottom board.

3. The thin connector structure of claim 1, wherein the two fourth walls of the lower iron shell have a third section that forms a slant section toward the second bottom board, the slant section further extending out a fourth section and the fourth section extending out a fifth section to the second bottom board.

4. The thin connector structure of claim 1, wherein the two first walls of the upper iron shell have at least one first buckling structure and the two third walls of the lower iron shell have at least one second buckling structure that matches with the first buckling structure.

* * * * *